US009985365B2

(12) United States Patent
Xie et al.

(10) Patent No.: US 9,985,365 B2
(45) Date of Patent: May 29, 2018

(54) CONNECTOR HAVING PARTITION PLATE WITH AN ELASTIC HOOK

(71) Applicant: Tyco Electronics (Shanghai) Co. Ltd., Shanghai (CN)

(72) Inventors: Bin Xie, Shanghai (CN); Yangrong Xue, Shanghai (CN); Hongquiang Han, Shanghai (CN); Zaohai Xue, Shanghai (CN); Wenyu Liu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days. days.

(21) Appl. No.: 15/441,894

(22) Filed: Feb. 24, 2017

(65) Prior Publication Data

US 2017/0250479 A1 Aug. 31, 2017

(30) Foreign Application Priority Data

Feb. 26, 2016 (CN) ..... 2016 2 0147047 U

(51) Int. Cl.

| | |
|---|---|
| ***H01R 13/648*** | (2006.01) |
| ***H01R 12/70*** | (2011.01) |
| ***H01R 13/50*** | (2006.01) |
| ***H01R 12/58*** | (2011.01) |

(52) U.S. Cl.
CPC ..... *H01R 12/7023* (2013.01); *H01R 12/585* (2013.01); *H01R 13/50* (2013.01)

(58) Field of Classification Search
CPC ..... H01R 13/6594
USPC ..... 439/607.21, 607.2, 607.25
See application file for complete search history.

(56) References Cited

U.S. PATENT DOCUMENTS

| | | | | |
|---|---|---|---|---|
| 6,729,905 | B1 * | 5/2004 | Hwang | H01R 13/65802 439/607.21 |
| 9,583,888 | B2 * | 2/2017 | Yang | H01R 13/659 |
| 2006/0234554 | A1 * | 10/2006 | Tsai | H01R 13/65802 439/607.25 |
| 2015/0364850 | A1 * | 12/2015 | Yang | H01R 13/659 439/607.25 |

* cited by examiner

*Primary Examiner* — Phuong Dinh
(74) *Attorney, Agent, or Firm* — Barley Snyder

(57) ABSTRACT

A connector is disclosed. The connector comprises a case having a top case and a bottom case and a partition plate disposed between the top case and the bottom case separating an inside space of the case into a plurality of receiving chambers. The bottom case has a first slot. The partition plate has a first side edge facing the bottom case and a first elastic hook formed on the first side edge. The first elastic hook is inserted into and elastically engages the first slot to connect the partition plate to the bottom case.

16 Claims, 6 Drawing Sheets

CONNECTOR HAVING PARTITION PLATE WITH AN ELASTIC HOOK

CROSS-REFERENCE TO RELATED APPLICATION

This application claims the benefit of the filing date under 35 U.S.C. § 119(a)-(d) of Chinese Patent Application No. 201620147047.5, filed on Feb. 26, 2016.

FIELD OF THE INVENTION

The present invention relates to a connector, and more particularly, to a C form-factor pluggable connector.

BACKGROUND

C form-factor pluggable (CFP) connectors are available in CFP, CFP2, and CFP 4 variants. Generally, a CFP2 connector or a CFP4 connector comprises a housing, also referred to as a cage, and partition plates. The partition plates are arranged between a top wall and a bottom wall of the housing to divide the inner space of the housing into a plurality of receiving chambers. Each receiving chamber is adapted to accommodate a terminal and comprises an insertion port through which a contacting terminal of a mating connector is inserted into the receiving chamber to come into contact with the terminal in the receiving chamber.

The insertion port of the CFP2 or CFP4 connector is required to be installed in an installing opening of an equipment housing to fix the CFP2 connector or CFP4 connector to the equipment housing. Generally, elastic pieces adapted to resist electromagnetic interference are provided between the outer circumference wall of the insertion port and an inner wall of the installing opening, so that the CFP2 connector or CFP4 connector has a resistance to electromagnetic interference and forms a more reliable electrical connection.

According to industry regulations, the width of the insertion port of each housing chamber of a CFP2 connector or CFP4 connector case (or cage) is 42.2 mm, which is nearly three times the width of the insertion port of an existing CFP connector or SFP connector. Since the insertion port of the case of the CFP2 connector or CFP4 connector has a larger width, when the insertion port of the case is mounted in the mounting opening of the apparatus housing, the outer peripheral wall of the insertion port of the case is subjected to deformation towards the inside of the connector under a compressing force, thus affecting the insertion of the plug of the mating connector.

In order to reduce the deformation of the outer peripheral wall of the insertion port of the case, a plate with larger thickness is used to manufacture the case. However, since the distance between the bottom wall of the case and the circuit board is constant, if the wall thickness of the case is increased, the length of the tongue-like connecting piece of the partition plate exposed from the bottom wall of the case becomes small, and the partition plate cannot be reliably connected to the bottom wall of the case.

SUMMARY

An object of the invention, among others, is to provide a connector having a partition plate which may be reliably connected to a bottom case even when the thickness of the bottom case is increased. The disclosed connector comprises a case having a top case and a bottom case and a partition plate disposed between the top case and the bottom case separating an inside space of the case into a plurality of receiving chambers. The bottom case has a first slot. The partition plate has a first side edge facing the bottom case and a first elastic hook formed on the first side edge. The first elastic hook is inserted into and elastically engages the first slot to connect the partition plate to the bottom case.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
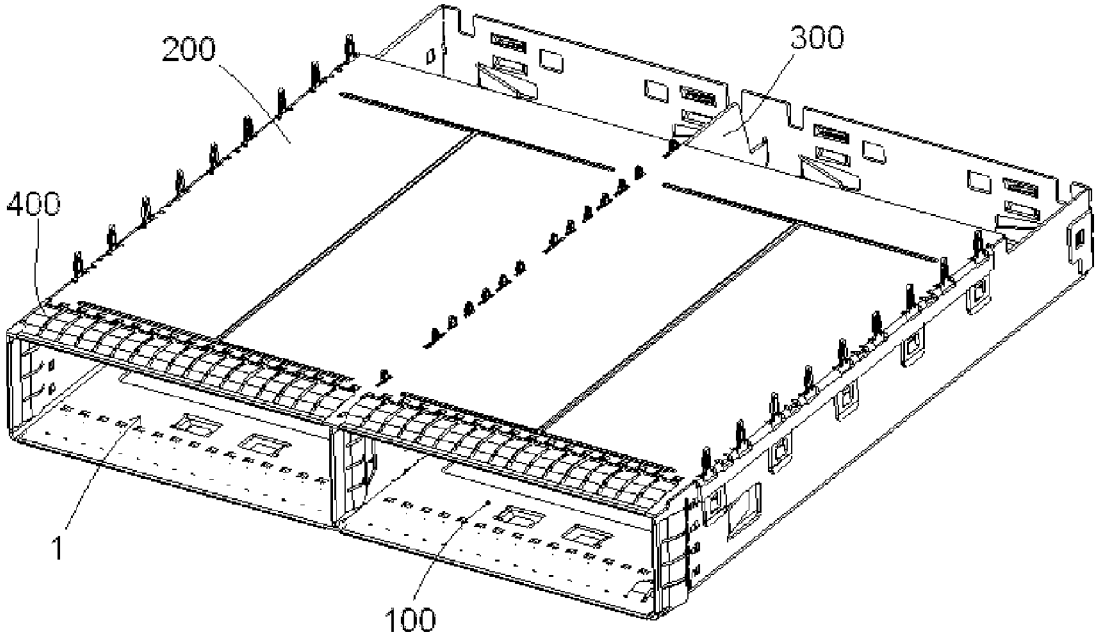
FIG. 1 is a bottom perspective view of a connector according to an embodiment of the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

Figure 2:
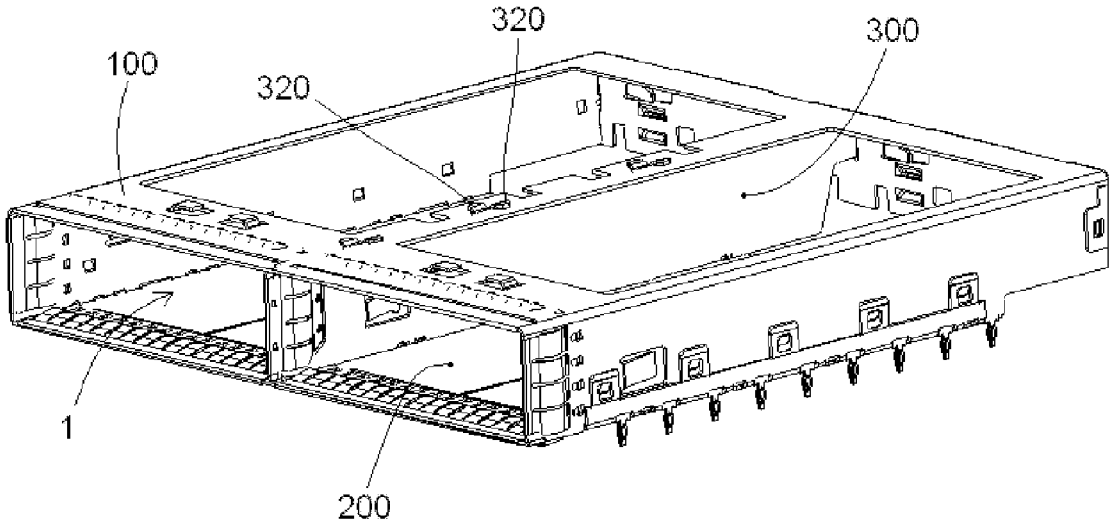
FIG. 2 is a top perspective view of the connector of FIG. 1.

A connector 100 according to the invention is shown generally in FIGS. 1 and 2. The connector includes a plurality of receiving chambers 1, a case 100, 200, a partition plate 300, and elastic pieces 400.

The case 100, 200 has a front end adapted to be mounted in a mounting opening of an equipment housing. The case 100, 200 comprises a top case 100 and a bottom case 200 assembled with each other. The partition plate 300 is disposed between the top case 100 and the bottom case 200 to separate an inside space of the case 100, 200 into the plurality of receiving chambers 1. In the embodiment shown in FIG. 1, the connector is a CFP2 connector or a CFP4 connector, and the width of the front end opening (insertion port) of each of the receiving chambers 1 of the connector is 42.2 mm.

Figure 4:
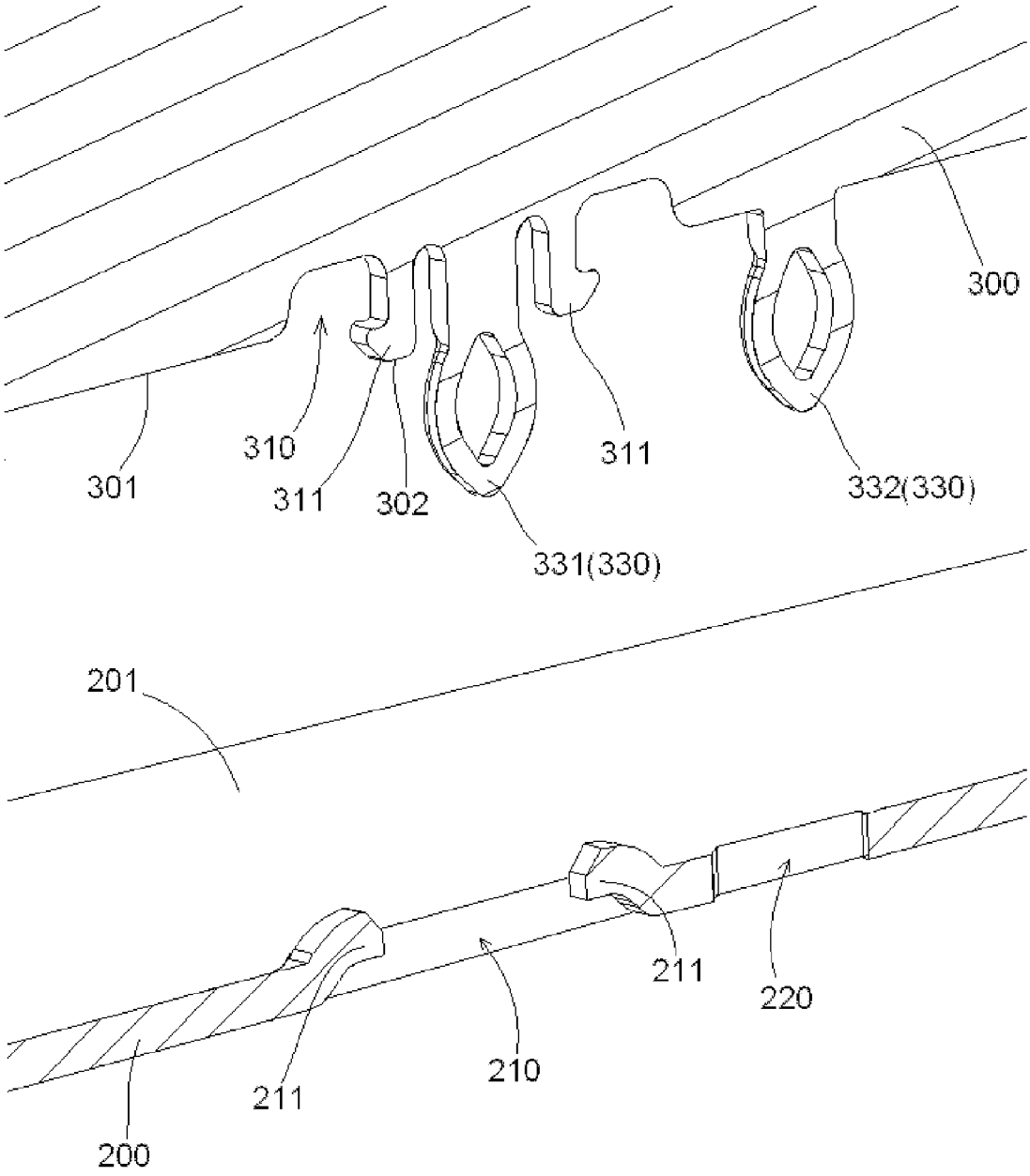
FIG. 4 is an enlarged view of a partition plate and a bottom case of the connector of FIG. 1.
Figure 5:
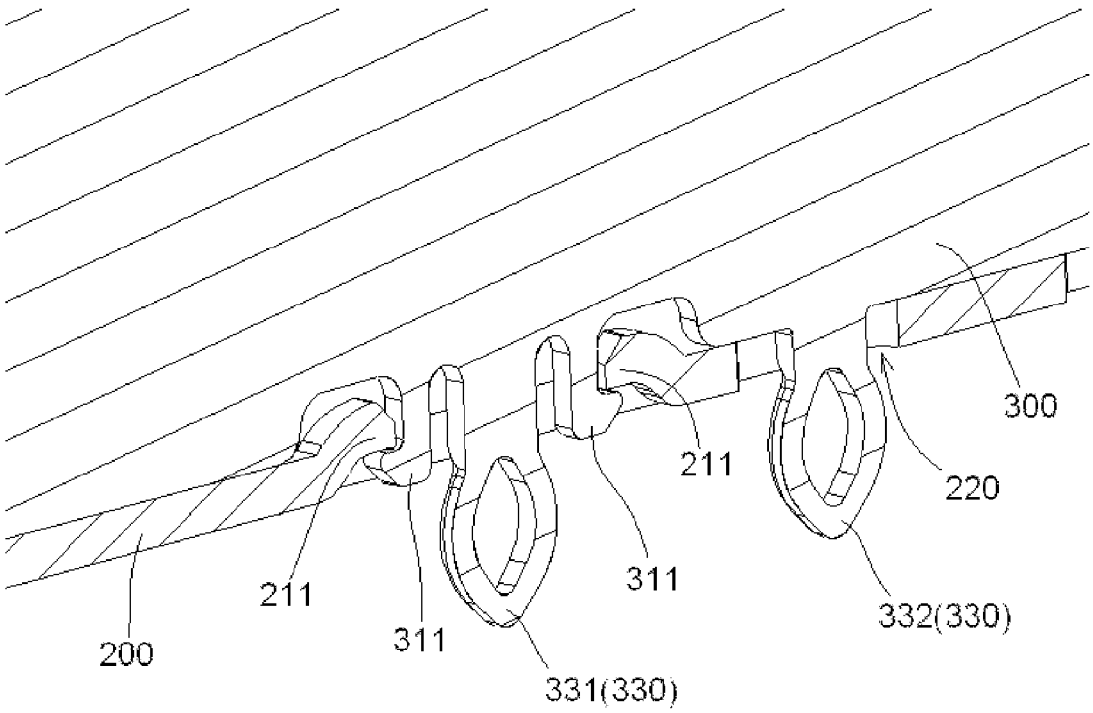
FIG. 5 is an enlarged view of the partition plate connected to the bottom case of FIG. 4.

The partition plate 300, as shown in FIGS. 4 and 5, has a first side edge facing the bottom case 200, and a first elastic hook 311 is formed on the first side edge of the partition plate 300. A first slot 210 is formed in the bottom case 200. The first elastic hook 311 is adapted to be inserted into the first slot 210 and elastically engaged to the first slot 210, so as to connect the partition plate 300 to the bottom case 200. A recess 310 is formed in the first side edge of the partition plate 300, the first elastic hook 311 being arranged in the recess 310. Each recess portions 310, as shown in FIGS. 4-6, has a pair of said first elastic hooks 311,311, wherein the pair of first elastic hooks 311,311 are disposed at both sides of a corresponding first pin 331 symmetrically.

An elastic cantilever 211 bent toward the inside of the connector is formed on the edge of the first slot 210. As clearly shown in FIG. 5, when the first elastic hook 311 is inserted in the first slot 210, the first elastic hook 311 is engaged with the cantilever 211 and the cantilever 211 is received in the recess 310. As shown in FIG. 6, a first guiding inclined surface 311*a* is formed on the first elastic hook 311 and a second guiding inclined surface 211*a* is formed on the cantilever 211. The first guiding inclined surface 311*a* is coupled with the second guiding inclined surface 211*a* to smoothly guide the first elastic hook 311 to an engaging position where the first elastic hook 311 is engaged to the cantilever 211. Thus, the partition plate 300 is reliably connected to the bottom case 200.

Figure 6:
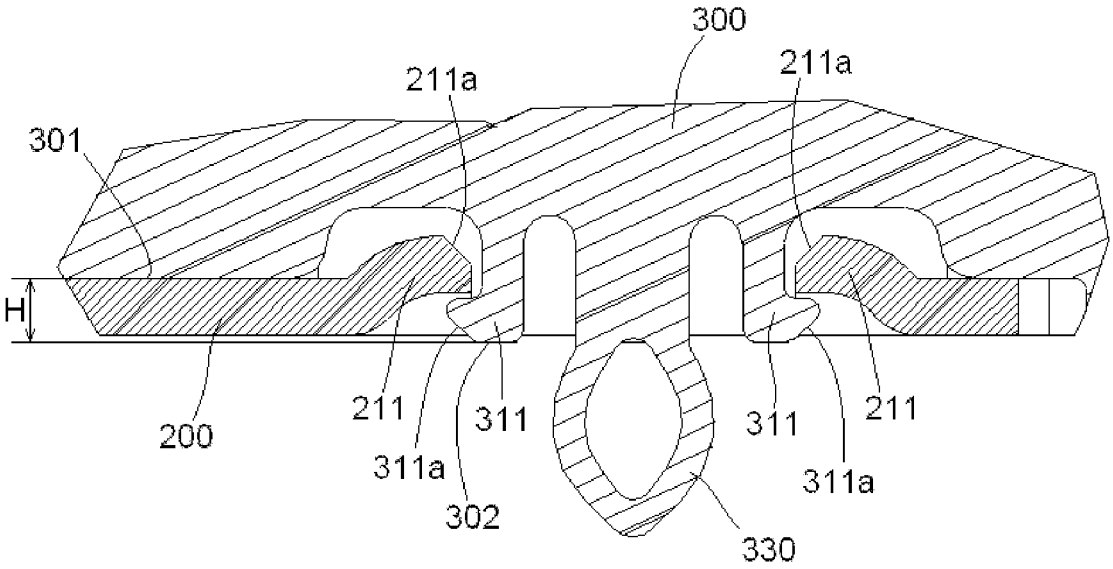
FIG. 6 is a sectional view of the partition plate connected to the bottom case of FIG. 4.

Also shown in FIGS. 4-6, when the first elastic hook 311 is engaged together with the cantilever 211, a bottom surface 301 of the first side edge of the partition plate 300 abuts against an inner surface 201 of the bottom case 200.

As shown in FIGS. 3-6, the first side edge of the partition plate 300 is further formed with a plurality of pins 330, such as fish eye shaped pins, adapted to be inserted into a circuit board. The pins 330 formed on the partition plate 300 comprise a first pin 331 located in the recess 310. The first pin 331 passes through the first slot 210 formed in the bottom case 200. The pins 330 further comprise a second pin 332 positioned outside of the recess 310, wherein the second pin 332 is adapted to pass through a second slot 220 formed in the bottom case 200. When the pins 330 of the partition plate 300 are plugged into the circuit board, a bottom surface 302 of the first elastic hook 311 abuts against a surface of the circuit board.

As shown in FIG. 6, a distance H between the bottom surface 301 of the first side edge of the partition plate 300 and the bottom surface 302 of the first elastic hook 311 is constant. Thus, a maximum wall thickness of the bottom case 200 is equal to the distance H between a bottom surface 301 of the first side edge of the partition plate 300 and the bottom surface 302 of the first elastic hook 311. In order to enhance the mechanical strength of the bottom case 200 and prevent the bottom case 200 from being deformed toward the inside of the connector under a compressing force of an equipment housing, the thickness of the bottom case 200 is increased to be equal to or slightly smaller than the distance H. The width of cantilever 211, as shown in FIGS. 4 and 5, is substantially equal to the thickness of the partition plate 300. The width of the first slot 210 is equal to or slightly larger than the thickness of the partition plate 300.

Figure 3:
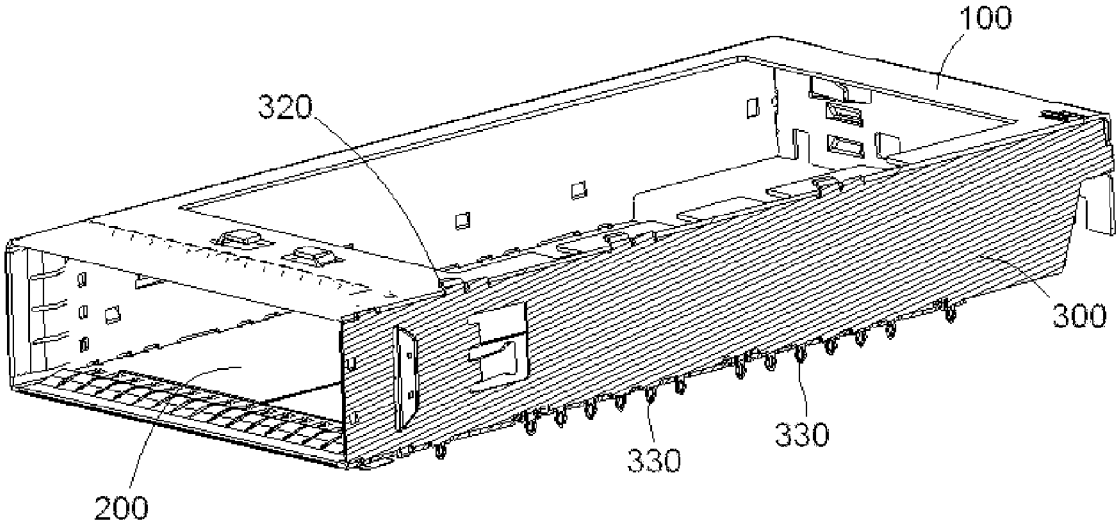
FIG. 3 is sectional view of the connector of FIG. 1.

The partition plate 300, as shown in FIGS. 2 and 3, has a second side edge facing the top case 100, with a plurality of pairs of top connectors 320 formed thereon. Each pair of top connectors 320 passes through a slot formed in the top case 100 and is bent towards two sides of the slot, abutting against an outer surface of the top case 100 and thus connecting the partition plate 300 to the top case 100.

The elastic pieces 400 are resistant to electromagnetic interference and are disposed around an outer peripheral wall of the front end of the case 100, 200, as shown in FIG. 1. When the front end of the case 100, 200 is mounted in the mounting opening of the equipment housing, the elastic pieces 400 are compressed between the outer peripheral wall of the case 100, 200 and an inner wall of the mounting opening of the apparatus housing, so that the case 100, 200 has a reliable and electrical connection with the equipment housing.

Advantageously, in the connector according to the present invention, the thicknesses of the case 100, 200 described above prevent the bottom case 200 from being deformed toward the inside of the connector by the compressing force of the equipment housing. Additionally, because the first elastic hook 311 engages the first slot 210, the partition plate 300 may be reliably connected to the bottom case 200 even when the thickness of the bottom case 200 is increased.

What is claimed is:

1. A connector, comprising:

a case having a top case and a bottom case, the bottom case having a first slot and an elastic cantilever disposed on an edge of the first slot and bent toward an inside of the connector; and a partition plate disposed between the top case and the bottom case and separating an inside space of the case into a plurality of receiving chambers, the partition plate having a first side edge facing the bottom case and a first elastic hook formed on the first side edge disposed in a recess of the first side edge, the first elastic hook inserted into and elastically engaging the first slot to connect the partition plate to the bottom case.

2. The connector of claim 1, wherein, when the first elastic hook is inserted in the first slot, the first elastic hook engages the cantilever and the cantilever is received in the recess.

3. The connector of claim 2, wherein, when the first elastic hook engages the cantilever, a bottom surface of the first side edge abuts an inner surface of the bottom case.

4. The connector of claim 3, wherein the first side edge has a plurality of pins adapted to be inserted into a circuit board.

5. The connector of claim 4, wherein, when the plurality of pins are inserted into the circuit board, a bottom surface of the first elastic hook abuts a surface of the circuit board.

6. The connector of claim 5, wherein a thickness of the bottom case is equal to or slightly smaller than a distance between the bottom surface of the first side edge and the bottom surface of the first elastic hook.

7. The connector of claim 6, wherein a thickness of the cantilever is substantially equal to a thickness of the partition plate.

8. The connector of claim 6, wherein the plurality of pins comprise a first pin disposed in the recess and extending through the first slot.

9. The connector of claim 8, wherein the recess has a pair of first elastic hooks each disposed symmetrically on one side of the first pin.

10. The connector of claim 9, wherein the plurality of pins comprise a second pin disposed outside of the recess and extending through a second slot in the bottom case.

11. The connector of claim 2, wherein the first elastic hook has a first guiding inclined surface and the cantilever has a second guiding inclined surface, the first guiding inclined surface coupled with the second guiding inclined surface to guide the first elastic hook to an engaging position engaging the cantilever.

12. The connector of claim 1, wherein the partition plate has a second side edge facing the top case, the second side edge having a plurality of pairs of top connectors disposed thereon.

13. The connector of claim 12, wherein each pair of top connectors extends through a slot formed in the top case and is bent toward opposite sides of the slot.

14. The connector of claim 13, wherein each pair of top connectors abuts against an outer surface of the top case, connecting the partition plate to the top case.

15. The connector of claim 1, further comprising a plurality of elastic pieces disposed around an outer peripheral wall of a front end of the case.

16. The connector of claim 1, wherein the connector is a CFP2 or CFP4 connector.

* * * * *